US008220555B1

(12) United States Patent
Wintill et al.

(10) Patent No.: US 8,220,555 B1
(45) Date of Patent: Jul. 17, 2012

(54) DOWNHOLE TOOL SHIFTING MECHANISM AND METHOD FOR SHIFTING A DOWNHOLE TOOL

(75) Inventors: Charles David Wintill, Houston, TX (US); William John Darnell, Houston, TX (US); William Ryle Darnell, St. Martinville, LA (US); Rodney Wayne Long, Cypress, TX (US); Todd Ulrich Chretien, Lafayette, LA (US)

(73) Assignee: Petroquip Energy Services, LLP, Houston, TX (US)

( * ) Notice: Subject to any disclaimer, the term of this patent is extended or adjusted under 35 U.S.C. 154(b) by 76 days.

(21) Appl. No.: 12/821,647

(22) Filed: Jun. 23, 2010

(51) Int. Cl.
*E21B 23/00* (2006.01)

(52) U.S. Cl. ..... 166/381; 166/242.7

(58) Field of Classification Search ..... 166/237, 166/242.7, 381
See application file for complete search history.

(56) References Cited

U.S. PATENT DOCUMENTS

| | | | | |
|---|---|---|---|---|
| 2,815,925 | A * | 12/1957 | Fisher, Jr. | 251/347 |
| 3,896,876 | A | 7/1975 | Crowe | |
| 4,433,725 | A * | 2/1984 | Bowyer | 166/66.4 |
| 4,880,058 | A * | 11/1989 | Lindsey et al. | 166/289 |
| 5,941,306 | A * | 8/1999 | Quinn | 166/120 |
| 7,290,617 | B2 | 11/2007 | Popilian et al. | |
| 7,617,875 | B2 | 11/2009 | Darnell et al. | |

* cited by examiner

*Primary Examiner* — David Andrews
(74) *Attorney, Agent, or Firm* — Buskop Law Group, PC; Wendy Buskop

(57) ABSTRACT

A downhole shifting mechanism having an inner tubular member, an outer tubular member, a piston, a first set of teeth, a sliding block, a body lock ring, a first flow path, and a second flow path is described herein. A downhole assembly can include the downhole shifting mechanism with a downhole tool connected to a second end of the downhole shifting mechanism. Also described is a method for shifting a downhole tool disposed within a wellbore.

12 Claims, 4 Drawing Sheets

DOWNHOLE TOOL SHIFTING MECHANISM AND METHOD FOR SHIFTING A DOWNHOLE TOOL

FIELD

The present embodiments generally relate to a downhole tool for shifting one or more pieces of downhole equipment.

BACKGROUND

A need exists for a convenient means of shifting one or more pieces of downhole equipment.

A further need exists for a downhole shifting mechanism that can move at least a portion of a downhole tool and can hold a position.

The present embodiments meet these needs.

BRIEF DESCRIPTION OF THE DRAWINGS

The detailed description will be better understood in conjunction with the accompanying drawings as follows.

Figure 1:
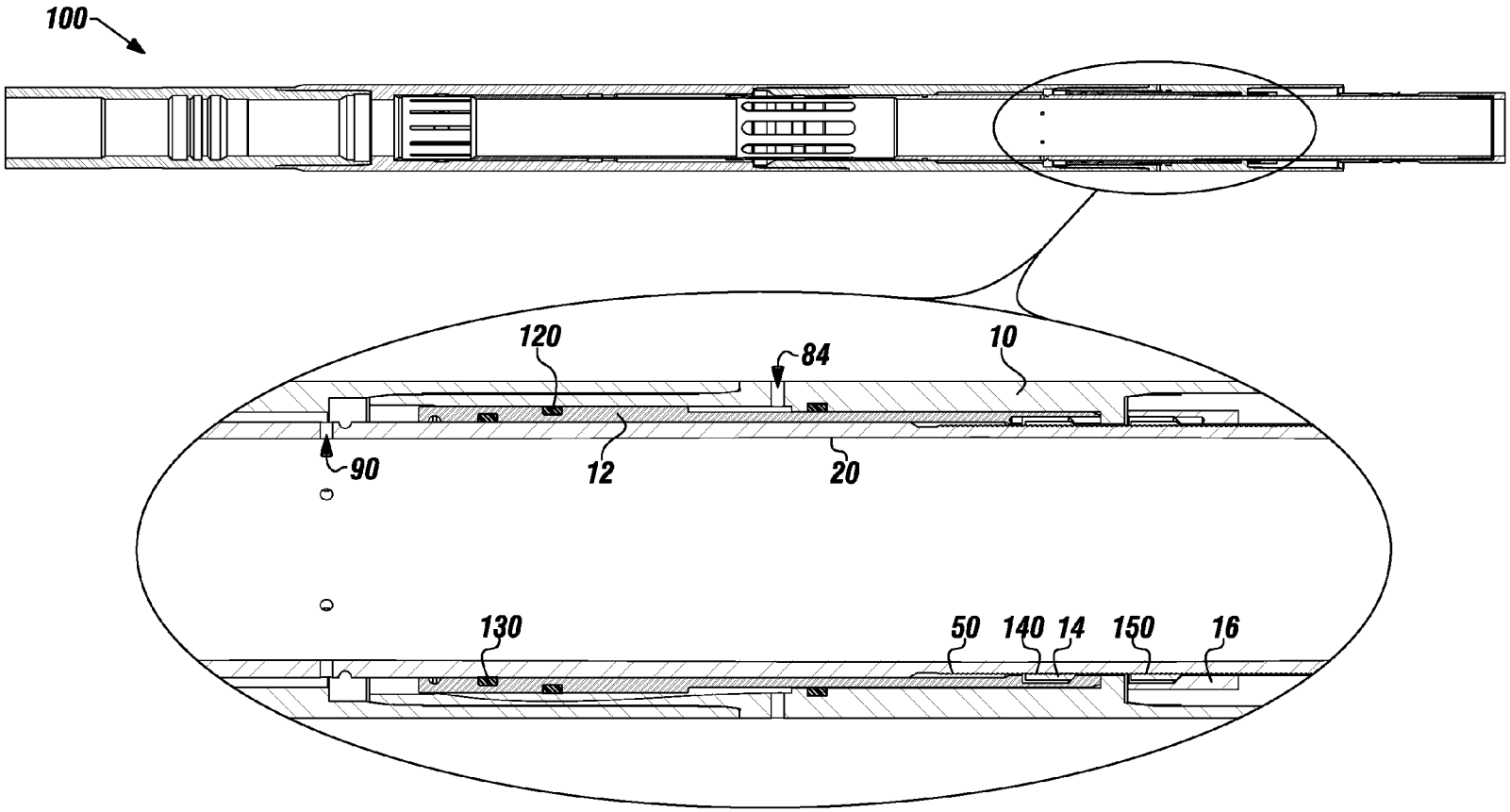
FIG. 1 is a cut view of an illustrative downhole shifting mechanism for shifting one or more pieces of downhole equipment.

The present embodiments are detailed below with reference to the listed Figures.

DETAILED DESCRIPTION OF THE EMBODIMENTS

Before explaining the present apparatus and method in detail, it is to be understood that the apparatus and method are not limited to the particular embodiments and that the apparatus and method can be practiced or carried out in various ways.

The present embodiments generally relate to a downhole shifting mechanism.

In one or more embodiments, the downhole shifting mechanism can include a first tubular member concentrically aligned with a second tubular member. A first set of teeth can be fixed relative to the first tubular member. A piston can be disposed between the tubular members, and a second set of teeth can be disposed on the piston. A third set of teeth can be fixed relative to the second tubular member.

In operation, the first tubular member can be disposed about the second tubular member, and the first tubular member can slide about the second tubular member, or the first tubular member can be disposed within the second tubular member and the first tubular member can slide within the second tubular member.

With the piston disposed between the tubular members, the second set of teeth can be configured to slide past the first set of teeth when moving in a first direction, and to engage the first set of teeth when moving in a second direction.

A first energy source can be in communication with a piston first end, and a second energy source can be in communication with a piston second end. The first and second energy sources can be the same or different. Illustrative energy sources can include hydraulic pressure, pneumatic pressure, springs, solenoids, magnets, or the like.

The third set of teeth can be fixed relative to the second tubular member and can engage the first set of teeth when the second set of teeth is moving in the first direction. The third set of teeth can be configured to not engage the first set of teeth when the second set of teeth is moving in the second direction.

In one or more embodiments, the downhole shifting mechanism can include an outer tubular member disposed about an inner tubular member. The downhole shifting mechanism can be used to shift one or more downhole tools. A downhole tool can be a packer, a sliding sleeve, a locking system, a shifting device, or combinations thereof. In one or more embodiments, the locking system can be similar to the locking system described in U.S. Pat. No. 7,617,875 issued Nov. 17, 2009, which is incorporated herein by reference.

A piston can be disposed between the inner tubular member and the outer tubular member. The piston can be cylindrical, or the piston can be another tubular member configured to act similar to a piston.

A first set of teeth can be disposed on or about the outer diameter of the inner tubular member. For example, the first set of teeth can be formed into the outer diameter of the inner tubular member.

A sliding block can be disposed between the first set of teeth and the piston. The sliding block can be connected to the piston and the inner tubular member.

The sliding block can include a second set of teeth. Accordingly, the piston can move the sliding block about the first set of teeth. The second set of teeth can be configured to slide about the first set of teeth when moving in a first direction. The second set of teeth can engage the first set of teeth when traveling in a second direction. In addition, the sliding block can move the inner tubular member when the first set of teeth is engaged with the second set of teeth.

A body lock ring can be secured to the outer tubular member. The body lock ring can include a third set of teeth. The body lock ring can be disposed between the inner diameter of the outer tubular member and the outer diameter of the inner tubular member. The body lock ring can be fixed relative to the outer tubular member.

The third set of teeth can be configured to slide about the first set of teeth when the inner tubular member is being moved by the sliding block. The third set of teeth can engage the first set of teeth when the second set of teeth are sliding about the first set of teeth.

A first flow path can be formed between the inner tubular member and the outer tubular member. The first flow path can be in fluid communication with the piston first end.

A second flow path can be formed through a portion of the inner tubular member. For example, the second flow path can be the inner bore of the inner tubular member. The second flow path can be in fluid communication with the piston second end.

The first flow path and the second flow path can be isolated from one another. For example, a seal can be disposed between the piston first end and the piston second end to isolate the flow paths from one another. In embodiments, a plurality of seals can be disposed between the piston first end and the piston second end.

In one or more embodiments, a downhole tool can be connected to a second end of the downhole shifting mechanism. A tubing string, a concentric string, or another downhole tubular can be connected to a first end of the downhole shifting mechanism.

A downhole assembly can be formed by connecting the downhole tool shifting mechanism to the downhole tool.

One or more embodiments of the downhole shifting mechanism can be used with a method for shifting a downhole tool disposed within a wellbore.

The method can include providing pressure to a first flow path of the downhole shifting mechanism. The first flow path can be in fluid communication with the piston first end.

The method can include moving the piston in a first direction. As the piston moves in the first direction, the piston can move a sliding block about a first set of teeth.

The method can also include providing pressure to a second flow path of the downhole shifting mechanism, and moving the piston in a second direction. The second direction can be opposite to the first direction.

As the piston moves in the second direction, the first set of teeth can engage the second set of teeth, and the piston can move the inner tubular member.

A third set of teeth can be disposed on a body lock ring that is static relative to the outer tubular member; thereby preventing the inner tubular member from moving in the first direction.

The inner tubular member can shift at least a portion of a downhole tool connected to a second end shifting mechanism.

Turning now to the Figures, FIG. 1 is a cut view of an illustrative downhole tool for shifting one or more pieces of downhole equipment. The downhole shifting mechanism 100 can include an inner tubular member 20, an outer tubular member 10, a piston 12, a first set of teeth 50, a sliding block 14, a body lock ring 16, a first flow path 90, and a second flow path 84.

The inner tubular member 20 can be any downhole tubular or any number of segments of downhole tubulars. The outer tubular member 10 can be any downhole tubular or any number of segments of downhole tubulars. The inner tubular member 20 can be movably disposed within the outer tubular member 10.

A piston 12 can be located in a chamber or space formed between the inner tubular member 20 and the outer tubular member 10. The piston 12 can move in a first direction and a second direction. The first direction can be down, left, right, or up.

The second direction can be a direction that is opposite to the first direction. For example, if the first direction is down, then the second direction can be up.

The piston 12 can have one or more seals (two are shown 120 and 130). The seals 120 and 130 can isolate the first flow path 90 from the second flow path 84.

The first flow path 90 can provide fluid communication between the inner bore of the inner tubular and the piston. The second flow path 84 can provide fluid between the outer diameter of the outer tubular member and the piston.

The first set of teeth 50 can be disposed about the inner tubular member 20. The first set of teeth 50 can be formed into the outer diameter of the inner tubular member 20 or disposed about the outer diameter of the inner tubular member 20.

The sliding block 14 can be disposed on or connected to the second end of the piston 12. The sliding block 14 can have a second set of teeth 140. The second set of teeth 140 can be configured to slide or move about the first set of teeth 50 when the piston moves in the first direction. The second set of teeth 140 can engage or snag the first set of teeth 50 when the piston 12 moves in the second direction. Accordingly, the piston 12 can move the inner tubular member 20 in the second direction.

The body lock ring 16 can be static relative to the outer tubular member 10. For example, the body lock ring 16 can be connected to the outer tubular member 10 or disposed within a notch formed into the inner diameter of the outer tubular member 10.

The body lock ring 16 can have a third set of teeth 150. The first set of teeth 50 can move about or past the third set of teeth 150 when moving in the second direction 110. The first set of teeth 50 can engage the third set of teeth 150 when moving in the first direction.

Figure 2:
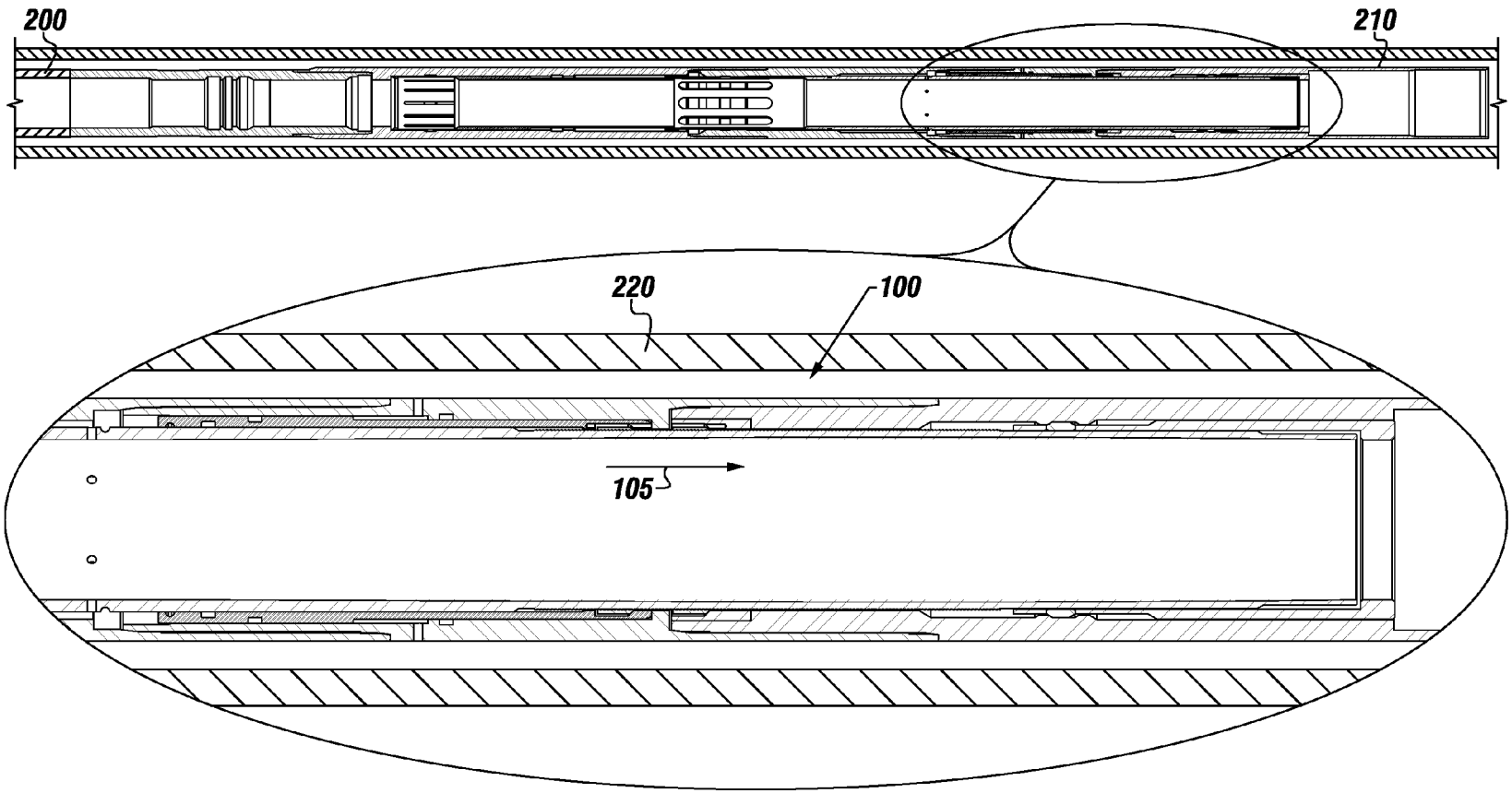
FIG. 2 depicts a schematic of a system incorporating a downhole shifting mechanism for shifting one or more pieces of downhole equipment with a piston moving in a first direction.

FIG. 2 depicts a schematic of an illustrative system incorporating a downhole shifting mechanism for shifting one or more pieces of downhole equipment with a piston moving in a first direction. Referring to FIGS. 1 and 2, the downhole shifting mechanism 100 can have a tubing string 200 connected to a first end of the downhole shifting mechanism and a downhole tool 210 connected to a second end of the downhole shifting mechanism.

The tubing string can be used to locate the downhole shifting mechanism 100 in the wellbore 220. Once properly located within the wellbore 220, pressure can be applied to the first flow path 90, and the piston 12 can move in the first direction 105. As the piston 12 moves in the first direction 105, the second set of teeth 140 can travel past the first set of teeth 50.

Figure 3:
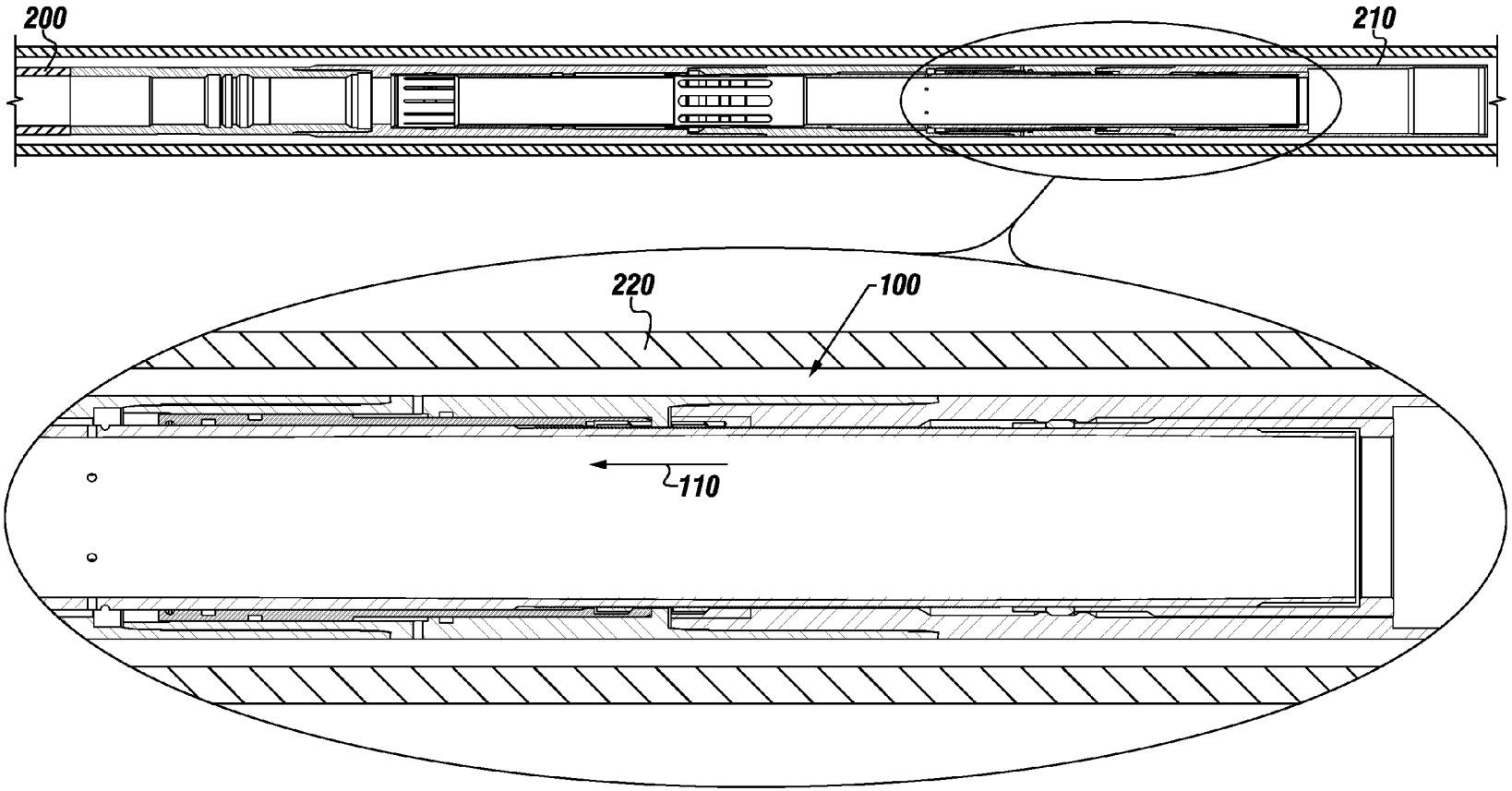
FIG. 3 depicts a schematic of the system of FIG. 2 with the piston moving in the second direction.

After the piston 12 has reached a second direction, the direction of the piston 12 can be reversed, as described in FIG. 3.

FIG. 3 depicts a schematic of the illustrative system of FIG. 2 with the piston moving in the second direction. Referring to FIGS. 3 and 1, pressure can be applied to the second flow path 84, and the piston 12 can move in the second direction 110.

As the piston 12 moves in the second direction, the first set of teeth 50 can engage the second set of teeth 140, and the piston 12 can move the inner tubular member 20 in the second direction 110. The inner tubular member can move at least a portion of the downhole tool 210. The piston 12 can be alternated between the first direction and the second direction until the inner tubular member is in an appropriate position.

Figure 4:
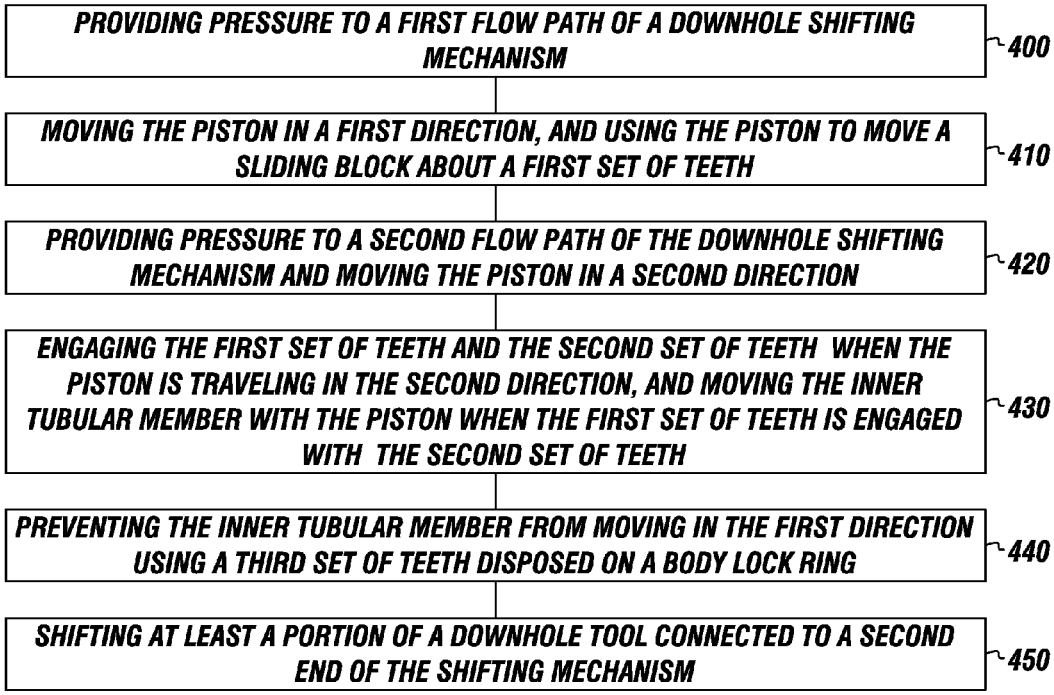
FIG. 4 depicts a flow diagram of an embodiment of a method for shifting a downhole tool.

FIG. 4 depicts a flow diagram of an embodiment of a method for shifting a downhole tool.

The method can include providing pressure to a first flow path of a downhole shifting mechanism, as depicted at box 400. The first flow path can be in fluid communication with a first end of a piston. The downhole shifting mechanism can include an outer tubular member disposed about an inner tubular member.

At box 410, the method can include moving the piston in a first direction, and using the piston to move a sliding block about a first set of teeth. Then in box 420, the method can include providing pressure to a second flow path of the downhole shifting mechanism and moving the piston in a second direction. The second direction can be opposite the first direction.

The method can also include engaging the first set of teeth and the second set of teeth when the piston is traveling in the second direction, and moving the inner tubular member with the piston when the first set of teeth is engaged with the second set of teeth, which is depicted at box 430.

As depicted in box 440 the method can include preventing the inner tubular member from moving in the first direction using a third set of teeth disposed on a body lock ring. The body lock ring can be static relative to the outer tubular member.

In addition, the method can include shifting at least a portion of a downhole tool connected to a second end of the downhole shifting mechanism, which is depicted at box 450.

While these embodiments have been described with emphasis on the embodiments, it should be understood that within the scope of the appended claims, the embodiments might be practiced other than as specifically described herein.

What is claimed is:

1. A downhole shifting mechanism comprising:

a. an inner tubular member;

b. an outer tubular member disposed about the inner tubular member;

c. a piston disposed between the inner tubular member and the outer tubular member;

d. a first set of teeth disposed about an outer diameter of the inner tubular member;

e. a sliding block connected to the piston, wherein the piston moves the sliding block about the first set of teeth, wherein the sliding block comprises a second set of teeth configured to slide about the first set of teeth when moving in a first direction, wherein the second set of teeth engage the first set of teeth when traveling in a second direction, and wherein the sliding block moves the inner tubular member when the first set of teeth are engaged with the second set of teeth;

f. a body lock ring disposed between an inner diameter of the outer tubular member and the first set of teeth, wherein the body lock ring is fixed relative to the outer tubular member, wherein the body lock ring comprises a third set of teeth configured to slide about the first set of teeth when the sliding block moves the inner tubular member, and wherein the third set of teeth engage the first set of teeth when the second set of teeth are sliding about the first set of teeth;

g. a first flow path to provide fluid communication between an inner bore of the inner tubular member and a piston first end; and h. a second flow path to provide fluid communication between an outer diameter of the outer tubular member and a piston second end, wherein the second flow path and the first flow path are isolated from one another.

2. The downhole shifting mechanism of claim 1, further comprising a downhole tool connected to an end of the downhole shifting mechanism.

3. The downhole shifting mechanism of claim 2, wherein the downhole tool comprises a packer, a sliding sleeve, a locking system, a shifting device, or combinations thereof.

4. The downhole shifting mechanism of claim 2, further comprising a tubing string connected to another end of the downhole shifting mechanism.

5. The downhole shifting mechanism of claim 1, wherein the piston is cylindrical.

6. The downhole shifting mechanism of claim 1, wherein a concentric string is connected to a first end of the downhole shifting mechanism.

7. The downhole shifting mechanism of claim 1, wherein a seal is disposed about the piston between the piston first end and the piston second end.

8. A method for shifting a downhole tool disposed within a wellbore, wherein the method comprises:

a. providing pressure to a first flow path of a downhole shifting mechanism, wherein the first flow path is in fluid communication with a first end of a piston, and wherein the downhole shifting mechanism comprises an outer tubular member disposed about an inner tubular member;

b. moving the piston in a first direction and using the piston to move a sliding block about a first set of teeth of the inner tubular member, wherein the sliding block has a second set of teeth;

c. providing pressure to a second flow path of the downhole shifting mechanism and moving the piston in a second direction, wherein the second direction is opposite to the first direction;

d. engaging the first set of teeth and the second set of teeth when the piston is traveling in the second direction, and moving the inner tubular member with the piston when the first set of teeth is engaged with the second set of teeth;

e. preventing the inner tubular member from moving in the first direction by using a third set of teeth disposed on a body lock ring, wherein the body lock ring is static relative to the outer tubular member; and f. shifting at least a portion of a downhole tool connected to a second end of the downhole shifting mechanism.

9. The method of claim 8, wherein the downhole tool comprises a packer, a sliding sleeve, a locking system, a shifting device, or combinations thereof.

10. The method of claim 8, further comprising a tubing string connected to a first end of the downhole shifting mechanism.

11. The method of claim 8, wherein the piston is cylindrical.

12. The method of claim 8, wherein a concentric string is connected to a first end of the downhole shifting mechanism.

* * * * *